US008429877B2

(12) United States Patent
Keller

(10) Patent No.: US 8,429,877 B2
(45) Date of Patent: Apr. 30, 2013

(54) METHOD FOR REINFORCEMENT OF CONCRETED PLATES IN THE REGION OF SUPPORT ELEMENTS

(75) Inventor: Thomas Keller, Lully (CH)

(73) Assignee: F.J. Aschwanden AG, Lyss (CH)

( * ) Notice: Subject to any disclaimer, the term of this patent is extended or adjusted under 35 U.S.C. 154(b) by 0 days.

(21) Appl. No.: 13/245,473

(22) Filed: Sep. 26, 2011

(65) Prior Publication Data

US 2012/0255257 A1 Oct. 11, 2012

(30) Foreign Application Priority Data

Oct. 6, 2010 (EP) ..... 10186650

(51) Int. Cl.
*E04B 1/00* (2006.01)

(52) U.S. Cl.
USPC ..... 52/745.17; 52/223.9; 52/223.11; 52/252

(58) Field of Classification Search ..... 52/167.3, 52/223.9, 223.11, 252, 741.3, 721.4, 745.17; 405/260, 303
See application file for complete search history.

(56) References Cited

U.S. PATENT DOCUMENTS

| | | | | | |
|---|---|---|---|---|---|
| 2,971,295 | A | * | 2/1961 | Reynolds | 52/223.7 |
| 3,086,273 | A | * | 4/1963 | Welborn | 264/228 |
| 3,190,065 | A | * | 6/1965 | Little | 57/212 |
| 3,247,635 | A | * | 4/1966 | Burns | 52/223.13 |
| 3,422,586 | A | * | 1/1969 | Parma | 52/223.14 |
| 3,436,923 | A | * | 4/1969 | Lagerstrom | 405/259.5 |
| 3,668,740 | A | * | 6/1972 | Pearson | 24/16 PB |
| 3,738,071 | A | * | 6/1973 | Finsterwalder | 52/155 |
| 3,974,601 | A | * | 8/1976 | Steadman | 52/86 |
| 4,121,325 | A | * | 10/1978 | Bruinette et al. | 24/122.6 |
| 4,132,498 | A | * | 1/1979 | Ikeda et al. | 405/259.4 |
| 4,652,179 | A | * | 3/1987 | Spang et al. | 405/259.2 |
| 5,671,572 | A | * | 9/1997 | Siller-Franco | 52/223.8 |
| 6,247,279 | B1 | * | 6/2001 | Murat et al. | 52/223.3 |
| 6,330,776 | B1 | * | 12/2001 | Jinno et al. | 52/649.1 |
| 6,647,678 | B1 | * | 11/2003 | Zambelli et al. | 52/252 |
| 7,056,463 | B2 | * | 6/2006 | Ohta | 264/228 |
| 7,553,108 | B2 | * | 6/2009 | Langwadt et al. | 405/259.1 |
| 7,574,840 | B1 | * | 8/2009 | Fyfe | 52/582.1 |

(Continued)

FOREIGN PATENT DOCUMENTS

| | | | |
|---|---|---|---|
| EP | 1905923 | A2 | 4/2008 |
| WO | 2009027543 | A2 | 3/2009 |

OTHER PUBLICATIONS

European Search Report for corresponding European Application 10 186 650.7 (with translation and list of documents).

*Primary Examiner* — Basil Katcheves
*Assistant Examiner* — Joshua Ihezie
(74) *Attorney, Agent, or Firm* — WRB-IP LLP

(57) ABSTRACT

A method is provided for reinforcing concreted plates in the region of support elements with reinforcement elements, which are each composed of a longitudinally stable, bendable, strap-like base body with two loops. A bore is made in the concreted plate for each reinforcement element. The end region of the bore remote from the pressure-side surface of the concreted plate is drilled out and the one loop of the reinforcement element is pressed together and is led through the bore until this loop has reached the drilled-out hole and expands. The bore is filled with a mortar-type mass. The other loop of the reinforcement element is fixed with an anchor head, which supports itself on the pressure-side surface of the concreted plate.

10 Claims, 6 Drawing Sheets

U.S. PATENT DOCUMENTS

| | | | | |
|---|---|---|---|---|
| 7,886,490 | B2 * | 2/2011 | Maekawa et al. | 52/223.14 |
| 7,926,181 | B2 * | 4/2011 | Li et al. | 29/897.34 |
| 8,215,068 | B2 * | 7/2012 | Bongiorno | 52/167.8 |
| 2001/0034997 | A1 * | 11/2001 | James | 52/742.16 |
| 2003/0140593 | A1 * | 7/2003 | Trundle | 52/741.3 |
| 2004/0052587 | A1 * | 3/2004 | Kulchin | 405/262 |
| 2004/0179901 | A1 * | 9/2004 | Kulchin | 405/262 |
| 2005/0235597 | A1 * | 10/2005 | Li et al. | 52/742.14 |
| 2006/0072972 | A1 * | 4/2006 | Spearing et al. | 405/259.1 |
| 2006/0254193 | A1 * | 11/2006 | Platts | 52/713 |
| 2007/0175165 | A1 * | 8/2007 | Hillman | 52/720.1 |
| 2008/0080945 | A1 * | 4/2008 | Bee et al. | 411/44 |
| 2009/0263572 | A1 * | 10/2009 | Wheatley | 427/136 |
| 2010/0101160 | A1 * | 4/2010 | Bongiorno | 52/167.1 |
| 2010/0146906 | A1 * | 6/2010 | Heath | 52/741.3 |
| 2011/0203195 | A1 * | 8/2011 | Hillman et al. | 52/80.1 |
| 2012/0174498 | A1 * | 7/2012 | Anderson, Jr. | 52/101 |

* cited by examiner

METHOD FOR REINFORCEMENT OF CONCRETED PLATES IN THE REGION OF SUPPORT ELEMENTS

BACKGROUND AND SUMMARY

The present invention relates to a method for reinforcement of concreted plates in the region of support elements, in particular supporting members and load-bearing walls, using reinforcement elements, which are each composed of a longitudinally stable, bendable, strap-like base body, both end regions of which are designed as loop, which loops have in the slack state a width a and which are inserted into the concreted plates to be reinforced.

In the region of support elements, in particular supporting members or load-bearing walls, the concreted plates, which can be designed as floor plates on which support elements come to stand or as ceiling plates which are supported by support elements, are reinforced in a targeted way through concrete reinforcements or other strengthening elements. Known are, for instance, reinforcing cages which are concreted in the plate to be set in concrete. All these reinforcement elements have the aim of being able to transmit into the concreted plate in as optimal a way as possible the supporting forces acting on the concreted plate through the supporting members or load-bearing walls, in order to prevent a local overload or even a punching of the support member through the concreted plate.

For example, when carrying out maintenance work on building regions of this kind, it is often necessary to reinforce the regions of the concreted plates which have to absorb the supporting forces generated by the supporting members. For this purpose bores can be made, for example, in the region to be reinforced of the concreted plate, which bores are disposed in a correspondingly inclined way and in which bores tension rods are placed, whose ends protruding on both sides beyond the concreted plate are provided with anchor heads which are supported on the respective surface of the concreted plate. The tension element can be tensioned through the correspondingly provided anchor heads. The bores can be filled with a mortar-type mass.

This type of reinforcements for concreted plates in the region of support elements has the drawback that the concreted plate to be reinforced must be accessible on both sides.

Tension rods which are of plug-like design can also be put in correspondingly made bores in the concreted plate. These tension rods have the disadvantage, however, that in many cases the force transmission is not optimal since the points of load incidence cannot be precisely established.

It is desirable to create a method for reinforcement of concreted plates in the region of support elements with which method reinforcement elements which are each composed of a longitudinally stable, bendable strap-like base body, and whose two end regions are each designed as loop, can be inserted in an optimal way in the concreted plate to be reinforced, and with which reinforcement elements the forces arising can be absorbed optimally.

According to an aspect of the invention a bore is made in the concreted plate for each reinforcement element, which bore is aligned inclined from the pressure-side surface toward the corresponding support element, and has a diameter d which is, smaller than the width a of the slack loop, in that the end region of the bore remote from the pressure-side surface is drilled out, in that one of the loops of the reinforcement element is pressed together and is led through the bore until this loop has reached the drilled-out hole and has expanded, in that at least the drilled-out end region of the bore is filled with a mortar-type mass and in that the other loop of the reinforcement element is fixed in an anchor head which supports itself on the pressure-side surface of the concreted plate.

Achieved through this solution is that an optimal reinforcement of the respective concreted plate can be obtained with relatively minimal time and effort. The anchoring elements can be put into the concreted plates from one side. The force receiving area is precisely defined so that an optimal reinforcement is ensured.

It is also possible that the bore is made in a continuous way through the concreted plate and the drilled-out hole is made from the surface opposite the pressure-side surface of the concreted plate, which simplifies the making of the bore for receiving the reinforcement element, but with the condition that the concreted plate is accessible from both sides.

To obtain an optimal anchoring of the inserted anchoring element in the concreted plate, it is advantageous for the entire bore to be filled with the mortar-type mass.

In a particularly simple way, the filling of the bore with the mortar-type mass takes place by means of an injection step.

Another advantageous embodiment of the method according to the invention is carried out in that the reinforcement element is tensioned after the hardening of the mortar-type mass and after the attachment to the anchor head. On the one hand, the desired tensions can thereby be obtained. On the other hand, it is also possible to retension, after a longer period of use, a reinforcement element correspondingly inserted in the concreted plate.

A simple connection between anchor head and reinforcement element is obtained by the anchor head being provided with a bolt which is inserted in the other loop of the reinforcement element.

In order to be able to achieve an optimal reinforcement of the concreted plate in the vicinity of a support element, a plurality of reinforcement elements is installed in this vicinity.

In order to be able to achieve optimal force absorption by the reinforcement elements inserted in the bores, these bores are made in the concreted plate in such a way that the angle of inclination a with respect to the pressure-side surface is about 30° to 60°.

In a advantageous way, a strap of carbon-fiber reinforced synthetic material is used as reinforcement element, making possible, on the one hand, a large absorption of forces and, on the other hand, allowing a simple handling, in particular in view of the weight of the respective strap. In addition, reinforcement elements of this kind are corrosion-resistant and fatigue-resistant.

BRIEF DESCRIPTION OF THE DRAWINGS

The method according to the invention will be explained more closely in the following, by way of example, with reference to the attached drawings.

DETAILED DESCRIPTION

Figure 1:
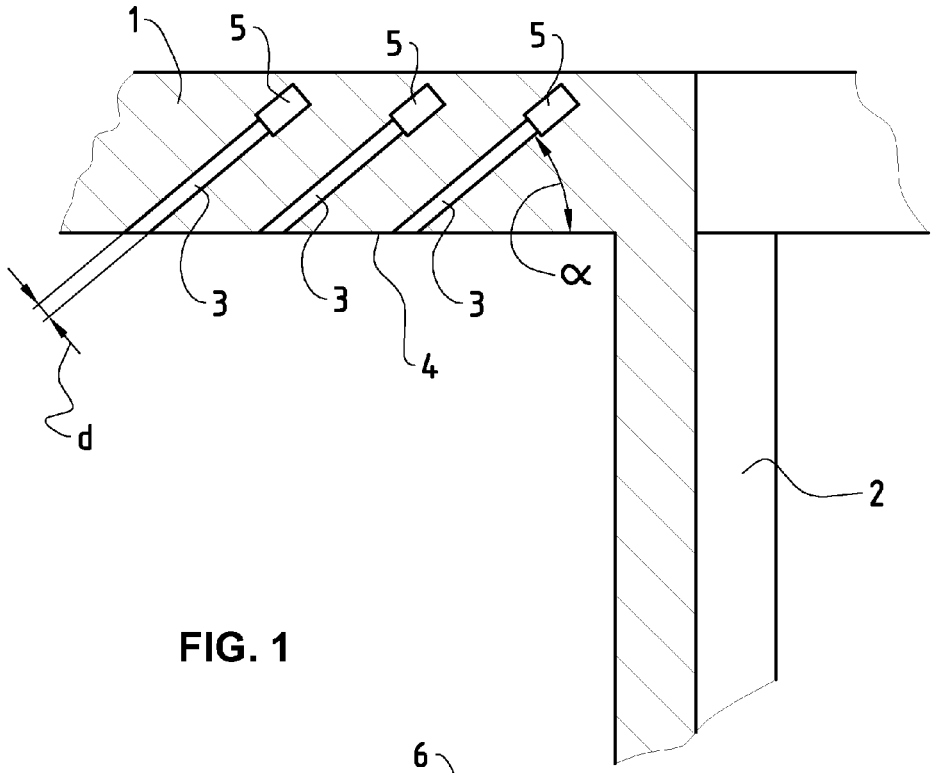
FIG. 1 shows a view of a concreted plate in the region of a support element, partially in section, with bores made therein for receiving reinforcement elements.

Visible in FIG. 1 is a concreted plate 1, which is supported by a support element 2. This support element 2 can be a supporting member, for example. It can also be a load-bearing wall or the like, however. Of course the concreted plate 1 is reinforced in the region of the support element 2 in a known way (not shown) with corresponding concrete reinforcements, for instance by means of so-called reinforcing cages.

Such a concreted plate 1 can be additionally reinforced in the region of the support elements 2. According to the method of the present invention, bores 3 are made in the concreted plate 1. These bores 3 are disposed in a way inclined from the pressure-side surface 4 of the concreted plate 1 at an angle $\alpha$ toward the corresponding support element 2. The angle $\alpha$ can thereby be about 30° to 60°. These bores 3 have a diameter d. The end region 5 of the respective bore 3 remote from the pressure-side surface 4 is drilled out to a diameter greater than the diameter d. This bore 3, designed as blind hole with the drilled-out end region 5, ends below the upper reinforcement layer of the concreted plate 1. An "injury" of said reinforcement layer is thereby excluded.

Seen in FIG. 2 is once again a concreted plate 1, which, as shown in FIG. 1, is supported by a support element 2. The bores 3 in this illustrated embodiment example are made through the concreted plate 1, it being possible for these bores 3 to be made from both sides of the concreted plate 1, if accessibility allows it. The end regions 5 opposite the pressure-side surface 4 can be drilled out via the surface 6, opposite the pressure-side surface 4, of the concreted plate. The positions of the reinforcement layers can thereby be detected by known methods so that the bores can be made through gaps in these reinforcement layers.

Figure 3:
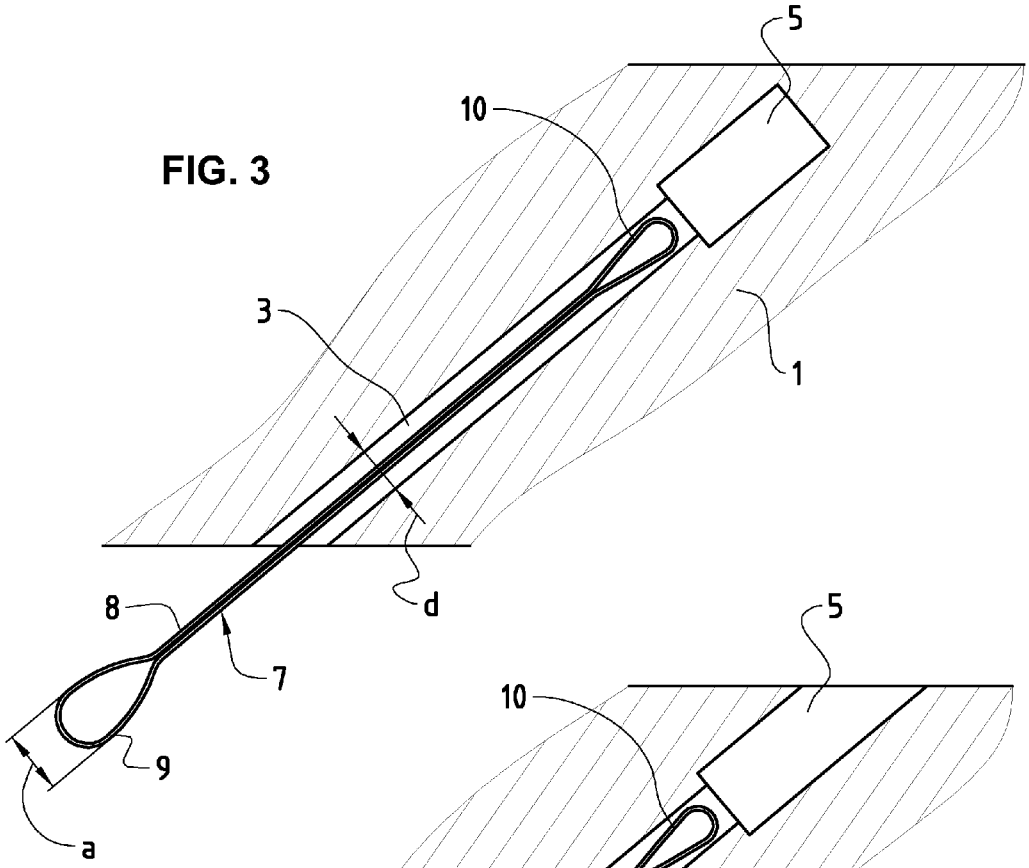
FIG. 3 shows a view of a reinforcement element during the insertion into a bore hole according to FIG. 1.

As can be seen from FIG. 3, a reinforcement element 7 can be inserted into a respective bore 3 according to FIG. 1 from the pressure-side surface 4. This reinforcement element 7 consists of or comprises a longitudinally stable, bendable strap-like base body 8, whose two end regions are each designed as loop 9 or respectively 10. In the slack state, the two loops 9 and 10 have a width a, which is greater than the diameter d of the respective bore 3.

These reinforcement elements 7 are advantageously composed of a carbon-fiber-reinforced synthetic material, and are known from the European patent specification EP 0 815 329 B1. Elements of this kind can be obtained, for example, from the company Carbo-Link. GmbH, Fehraltdorf, Switzerland.

For insertion of this reinforcement element 7 in the bore 3, the one loop 10 of this reinforcement element 7 is pressed together so that the corresponding width a is smaller than the diameter d of the bore 3. The reinforcement element 7 can then be pushed into the bore 3, as can be seen in FIG. 3.

Figure 2:
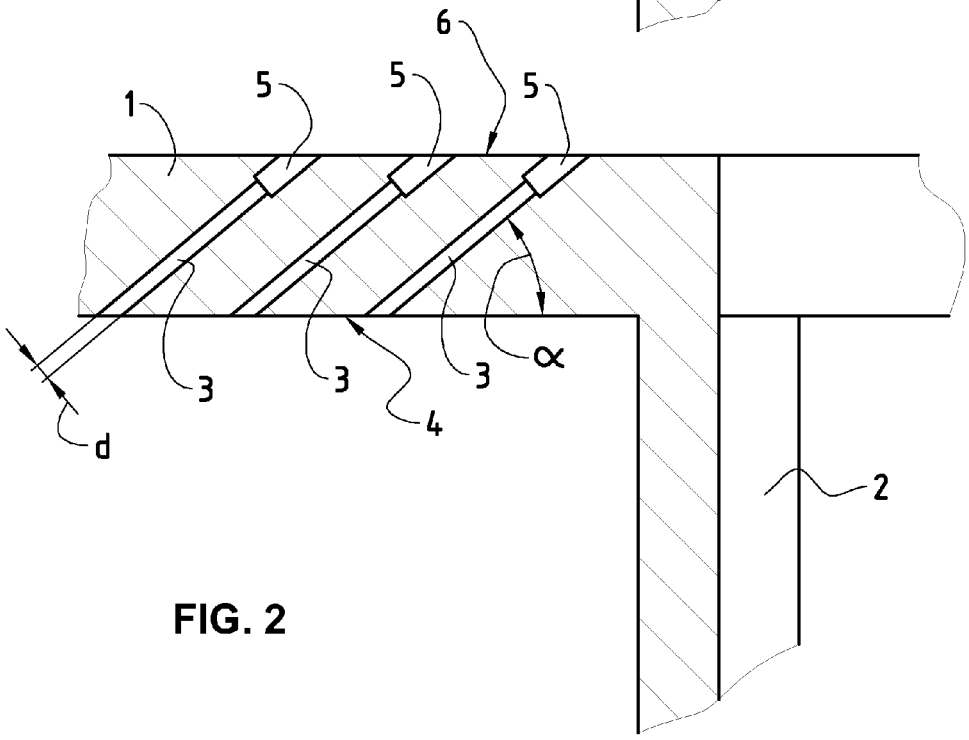
FIG. 2 shows a view according to FIG. 1, the bores in the concreted plate here being designed continuous.
Figure 4:
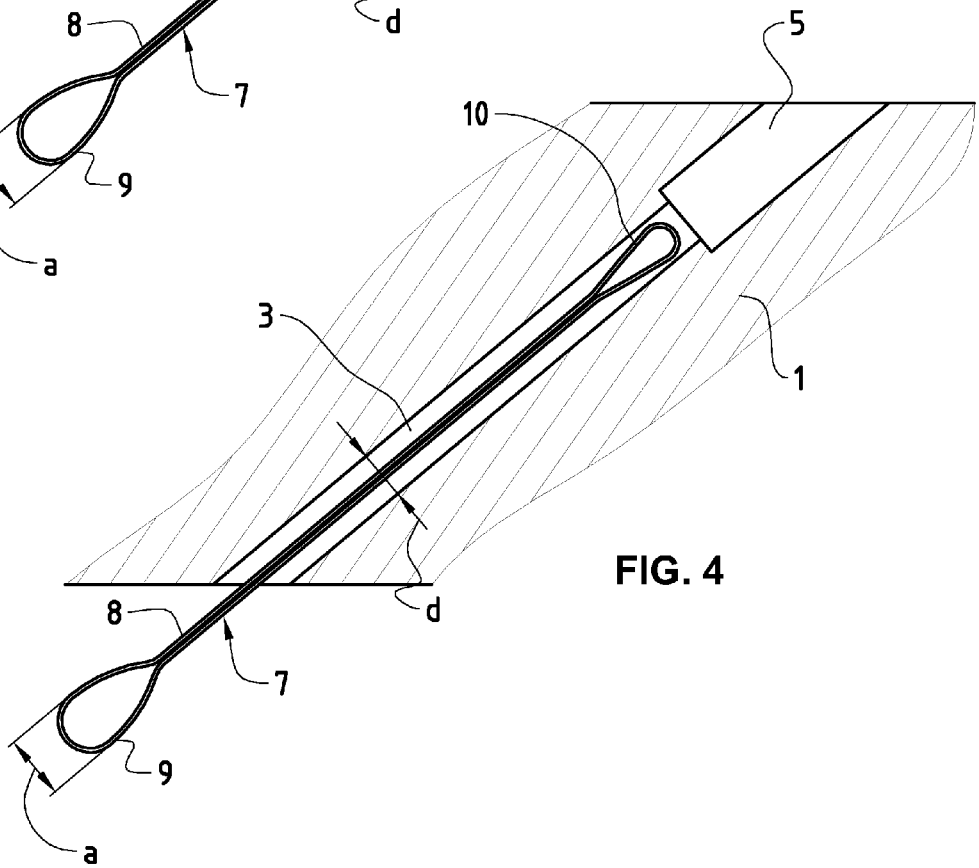
FIG. 4 shows a view of a reinforcement element during the insertion into a bore hole according to FIG. 2.

As shown in FIG. 4, a respective reinforcement element 7 as has been described with reference to FIG. 3 can also be inserted in a corresponding way into a bore 3 according to FIG. 2.

Figure 5:
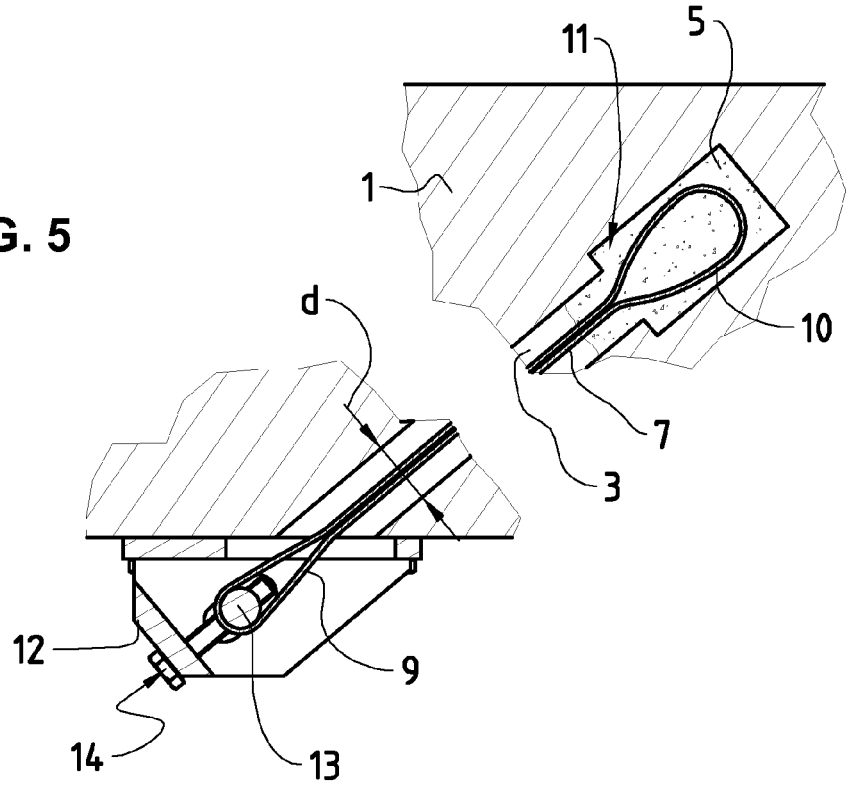
FIG. 5 shows in section a view of a completely mounted reinforcement element in a bore according to FIG. 1.
Figure 6:
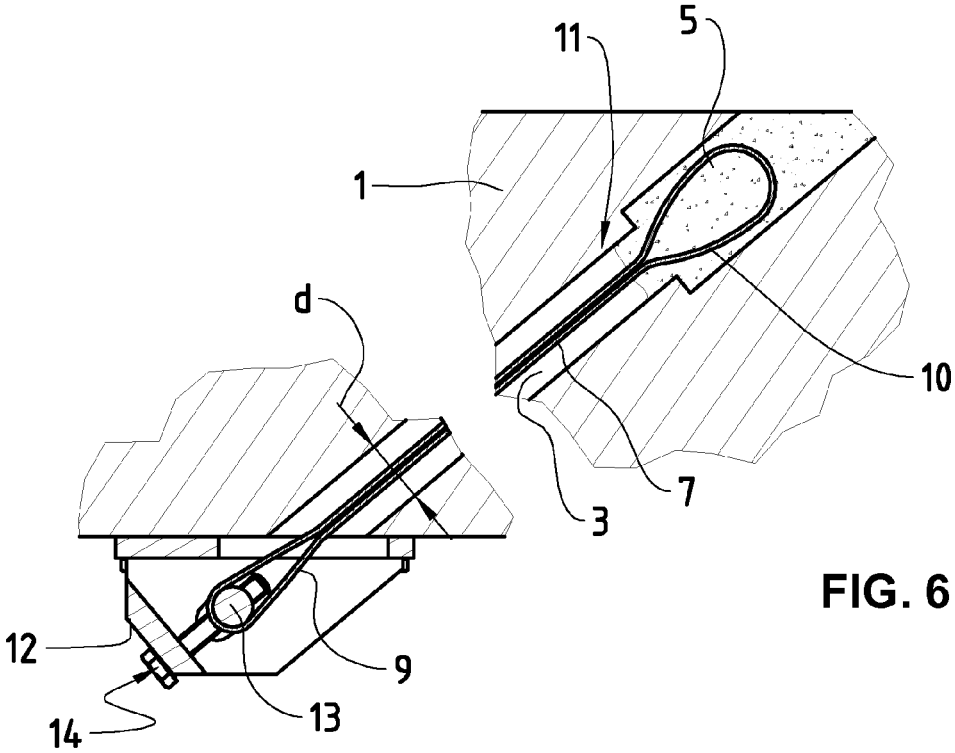
FIG. 6 shows in section a view of a completely mounted reinforcement element in a bore according to FIG. 2.

As can be seen from FIGS. 5 and 6, the respective reinforcement element 7 is pushed into the corresponding bore 3 until the one loop 10 ends up in the drilled-out end region 5. In this end region 5 this loop 10 then expands again to a width which is greater than the diameter d of the bore 3.

The drilled-out end region 5 and at least the area of the bore adjacent thereto are then tilled with a mortar-type mass 11. This can take place, for example, in a known way through injection of this mortar-type mass into the bore 3. After the hardening of this mortar-type mass 11, this other loop 9 of the reinforcement element 7, which loop protrudes out of the concreted plate 1, is fixed to a respective anchor head 12. This anchor head 12 has in a known way a bolt 13, which can be inserted in the other loop 9 of the reinforcement element 7 and which can be moved, likewise in a known way via tensioning means 14, such that the reinforcement element 7 is tensioned. Such a tensioning can also be achieved in a known way by means of an additional device placed on the anchor head, which device is hydraulically operated, for instance. Of course other suitable types of anchor head can also be used.

After installation of the anchor head 12 on the reinforcement element 7 and tensioning of the reinforcement element 7 through this anchor head 12, the remaining region of the bore 3 can still be filled with a mortar-type mass 11, if necessary. This mortar-type mass can have a different composition and/or consistency than the mortar-type mass with which the drilled-out end region 5 is filled.

Such a bore for a concreted plate having, for example, a thickness of about 300 mm, has, for instance, a total length of 550 mm. The drilling out of the end region 5 is carried out, for example, over a length of 100 mm. The original bore has, for instance, a diameter d of about 30 mm. The end region 5 of this bore 3 is then drilled out to about 50 mm. Of course the indicated dimensions are adaptable to the respective case.

The reinforcement element 7 thus installed in the concreted plate 1 is distinguished in particular in that the point of load incidence of the anchorage is clearly established, and is located in the upper turn-around region of the one loop 10. Also achieved through this configuration is that the point of load incidence is located statically at the correct height of the concreted plate 1 to have an optimal effect. The reinforcement elements 7 can be inserted in the concreted plate 1 from below, if necessary. A corrosion-resistant and fatigue-resistant system is obtained through the use of carbon fiber-reinforced synthetic material for the reinforcement elements 7. Moreover the tension force acting on the anchor head can be checked at any time. If necessary, a retensioning of the anchor head 12 for the reinforcement element 7 is easily possible.

As can be seen from FIGS. 7 to 10, a plurality of reinforcement elements 7 can be used in the region of a support element 2 for a concreted plate 1. As can be seen from FIGS. 7 and 9, the reinforcement elements can thereby be disposed star-shaped with concentric spacing apart from the support element 2, whereby an optimal reinforcement of the concreted plate 1 is obtained. If the support element is a wall, for example, the reinforcement elements 7 can be inserted in the concreted plate in a plurality of rows disposed parallel to this wall.

Figure 7:
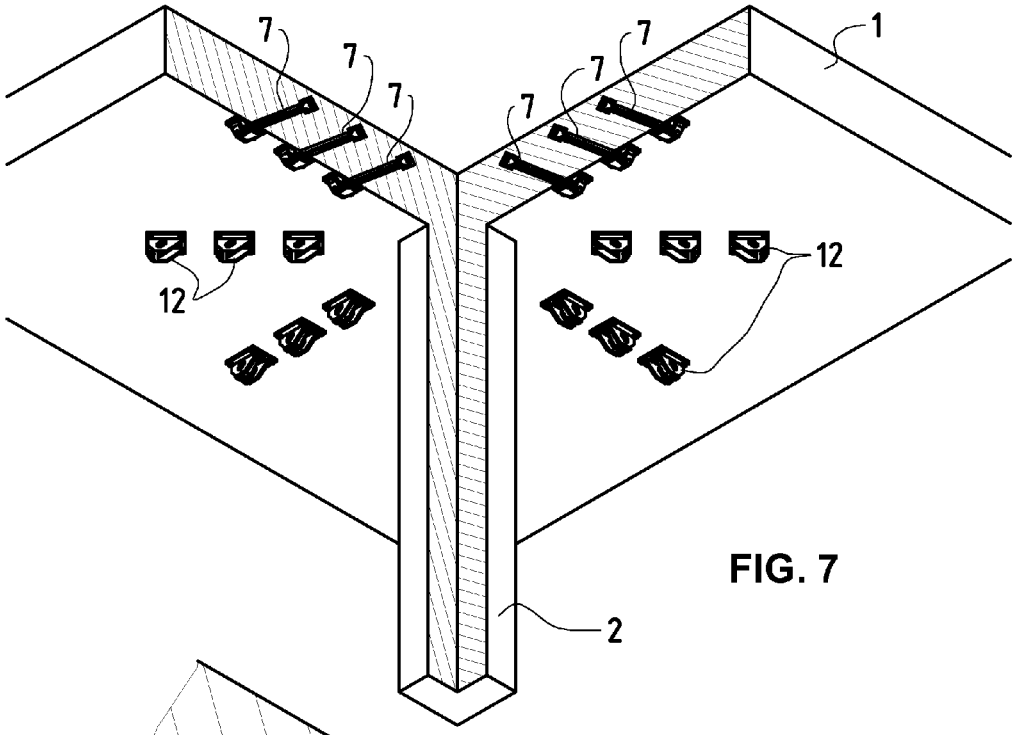
FIGS. 7 and 8 show a view of a configuration of several reinforcement elements which are inserted in bores according to FIG. 1 in the concreted plate.
Figure 8:
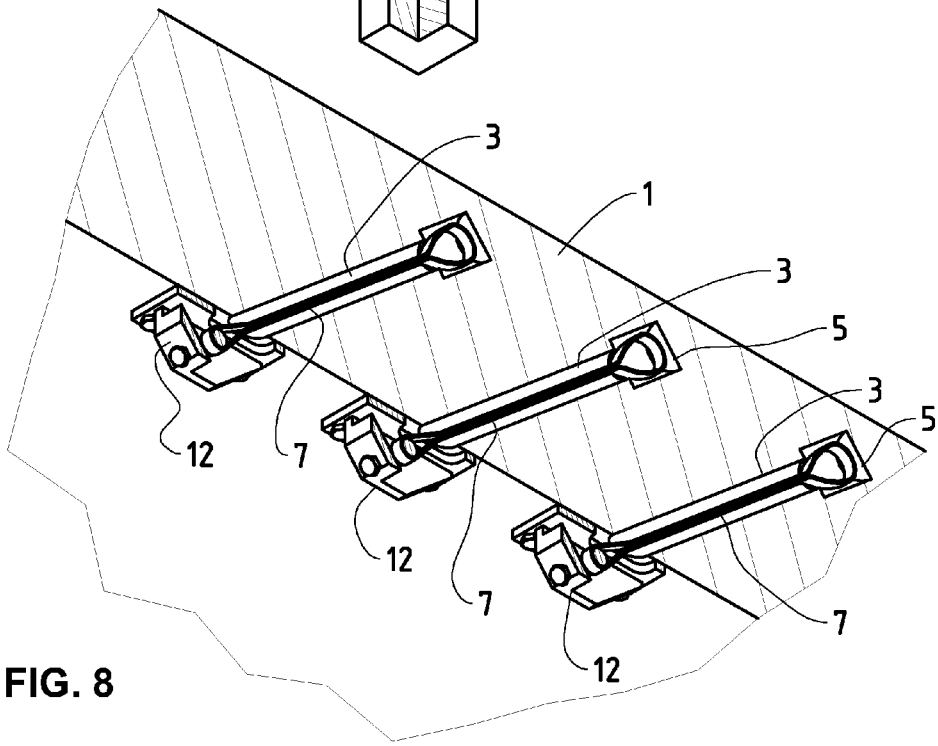
Figure 9:
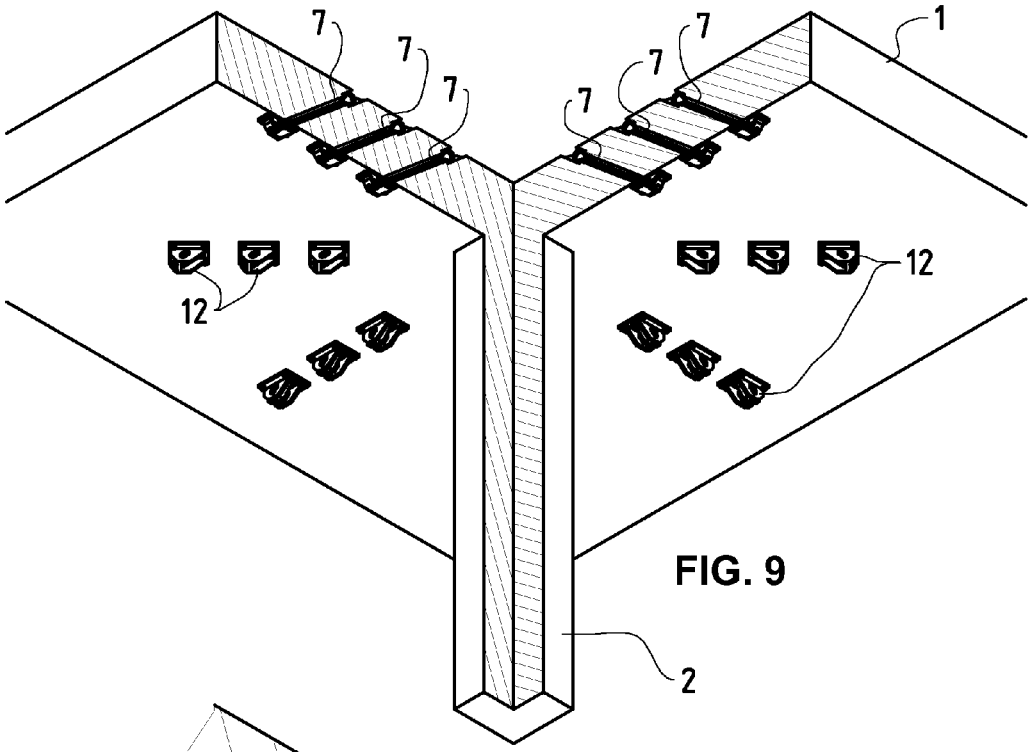
FIGS. 9 and 10 show a view of a configuration of several reinforcement elements which are inserted in bores according to FIG. 2 in the concreted plate.
Figure 10:
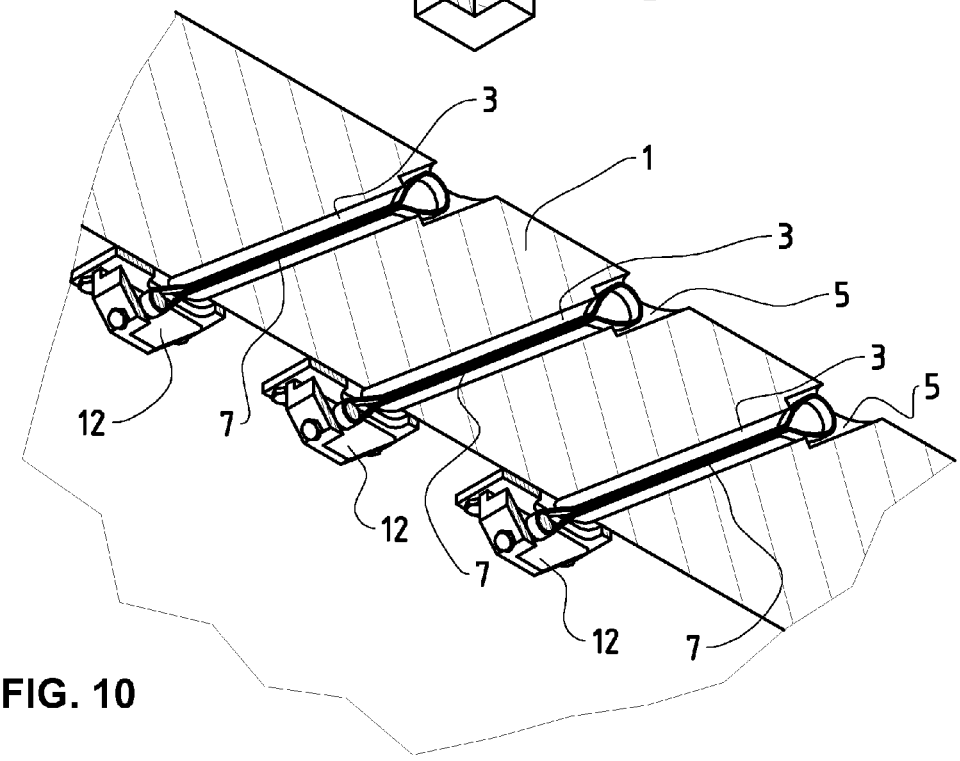

In FIGS. 7 and 8, the reinforcement elements 7 are inserted in bores 3 as have been previously described with reference to FIG. 1, while in FIGS. 9 and 10 the reinforcement elements 7 are inserted in bores 3 as have been previously described with reference to FIG. 2.

Figure 11:
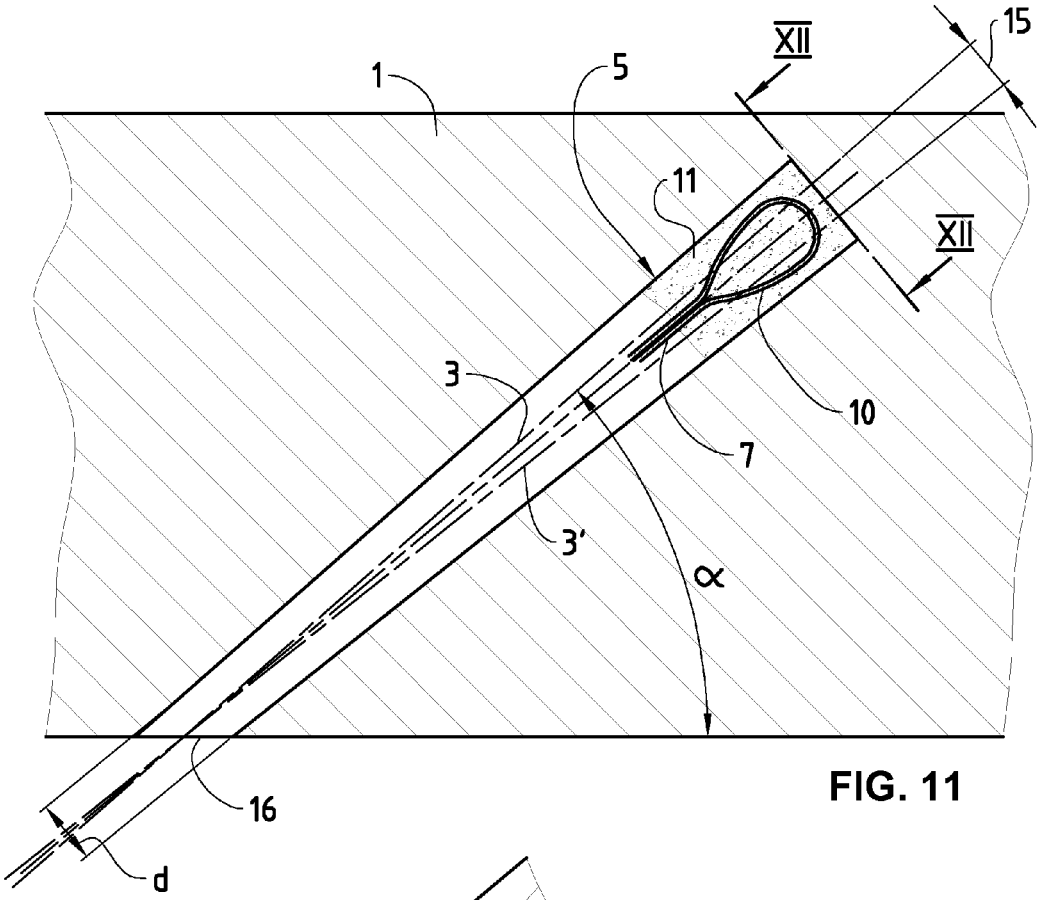
FIG. 11 shows a view of a concreted plate in the region of a support element, partially in section, with a further embodiment of the bores made therein for receiving reinforcement elements.

Shown in FIG. 11 is a further possibility for design of a bore in a concreted plate 1. Once again a first bore 3 is made having a diameter d. This bore ends below the upper reinforcement layer (not shown) of the concreted plate 1. A further bore 3' is made with the same starting hole 16 as the bore 3, which further bore is slightly inclined with respect to the angle α of the first bore 3, shown by double arrow 15, so that an inwardly opening, partially conical hole results. A drilled-out end region 5 is also thereby obtained. The one loop 10, once again pressed together, of the reinforcement element 7 can be inserted into these bores 3 and 3' in the same way as previously described. In the rear region of the bore 3, 3' this one loop 10 slackens again. Afterwards the mortar-type mass can be put in, and the anchoring of the other loop of the reinforcement element 7 carried out, as has been previously described with reference to FIG. 3 and FIG. 5.

Figure 12:
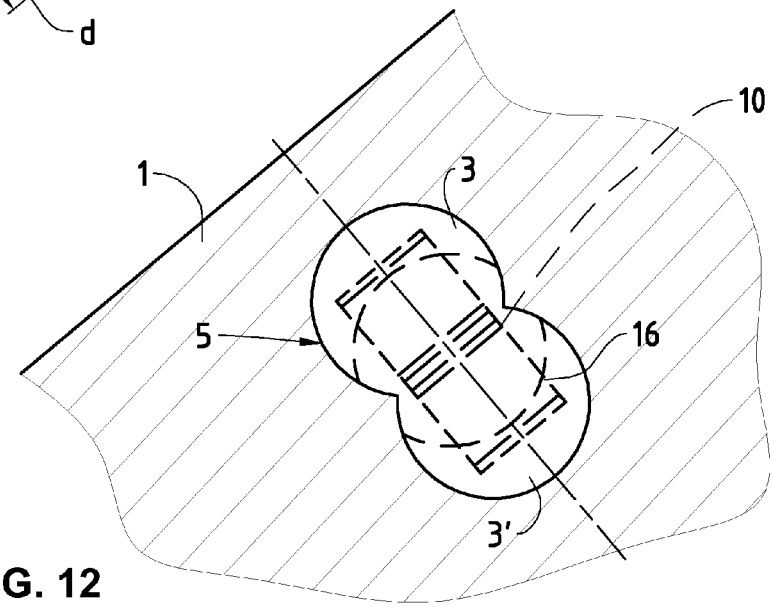
FIG. 12 shows a sectional representation of the bore along line XII-XII according to FIG. 11.

FIG. 12 shows in section a view of the bore 3 and 3', which is made in the concreted plate 1 from the pressure-side surface 4.

An optimal anchoring of the one loop 10 of the reinforcement element 7 in the concreted plate 1 is obtained also with this embodiment.

By means of this method according to the invention, concreted plates in the region of support elements can be additionally reinforced in an optimal way. In particular reinforcement can thereby be achieved in which the force transmission is optimal. With regard to the reinforcement elements inserted in the concreted plate, their tensioning can be checked at any time. If necessary, it is easily possible to retension these reinforcement elements. The reinforcement elements are corrosion-resistant and fatigue-resistant. The application possibilities are manifold.

The invention claimed is:

1. A method for reinforcing concreted plates in the region of support elements, comprising providing reinforcement elements that are each composed of a longitudinally stable, bendable, strap-like base body, opposite end regions of which being designed as a loop, the loops having, in a slack state, a width a, making a bore in the concreted plate for each reinforcement element, the bore being inclined from a pressure-side surface toward a corresponding support element, and having a diameter d which is smaller than the width a of the slack loop, an end region of the bore remote from the pressure-side surface being drilled out to a second diameter greater than the diameter d of the bore, inserting each reinforcement element into a corresponding bore in the concreted plates to be reinforced, including pressing together one of the loops of the reinforcement element at a first end of the reinforcement element and leading the pressed together loop through the bore until the pressed together loop has reached the drilled-out hole at the end region of the bore and permitting the pressed together loop to expand to a size greater than the diameter d of the bore, filling at least the drilled-out end region of the bore with a mortar-type mass, and fixing a loop at a second end of the reinforcement element to an anchor head which supports itself on the pressure-side surface of the concreted plate.

2. The method according to claim 1, wherein the bore is made in a continuous way through the concreted plate and the drilled-out hole is made from the surface opposite the pressure-side surface of the concreted plate.

3. The method according to claim 1, wherein the entire bore is filled by the mortar-type mass.

4. The method according to claim 1, wherein the filling with the mortar-type mass is carried out with an injection step.

5. The method according to claim 1, wherein the reinforcement element is tensioned after the hardening of the mortar-type mass and after the attachment to the anchor head.

6. The method according to claim 1, wherein the anchor head is provided with a bolt, which is inserted in the loop at the second end of the reinforcement element.

7. The method according to claim 1, wherein a plurality of reinforcement elements is installed in the vicinity of the support element.

8. The method according to claim 1, wherein the reinforcement elements inserted in the concreted plate are retensioned.

9. The method according to claim 1, wherein the bores for the reinforcement elements are made in the concreted plate in such a way that an angle of inclination α with respect to the pressure-side surface is about 30° to 60°.

10. The method according to claim 1, wherein a strap of carbon-fiber reinforced synthetic material is used as the reinforcement element.

* * * * *